US006733660B2

(12) United States Patent
Pradhan et al.

(10) Patent No.: US 6,733,660 B2
(45) Date of Patent: May 11, 2004

(54) MULTISTAGE PROCESS FOR REMOVAL OF SULFUR FROM COMPONENTS FOR BLENDING OF TRANSPORTATION FUELS

(75) Inventors: Vivek R. Pradhan, Houston, TX (US); Ptoshia A. Burnett, Aurora, IL (US); Stacey McDaniel, Riverside, IL (US); Michael Hodges, Wonersh (GB)

(73) Assignee: BP Corporation North America Inc., Warrenville, IL (US)

( * ) Notice: Subject to any disclaimer, the term of this patent is extended or adjusted under 35 U.S.C. 154(b) by 19 days.

(21) Appl. No.: 09/918,984

(22) Filed: Jul. 31, 2001

(65) Prior Publication Data

US 2003/0029776 A1 Feb. 13, 2003

(51) Int. Cl.[7] ..... C10G 31/00

(52) U.S. Cl. ..... 208/218; 208/238; 208/237; 208/208 R

(58) Field of Search ..... 208/218, 238, 208/208 R, 237

(56) References Cited

U.S. PATENT DOCUMENTS 3,996,128 A 12/1976 Espenscheid et al. ..... 208/89
5,401,280 A * 3/1995 Kaneko et al. ..... 44/449
6,024,865 A * 2/2000 Alexander et al. ..... 208/218
6,059,962 A * 5/2000 Alexander et al. ..... 208/238

* cited by examiner

*Primary Examiner*—Walter D. Griffin
*Assistant Examiner*—James Arnold, Jr.
(74) *Attorney, Agent, or Firm*—Patrick L. Kim; Ekkehard Schoettle

(57) ABSTRACT

Economical processes are disclosed for the production of fuels of reduced sulfur content from a feedstock, typically derived from natural petroleum, wherein the feedstock is comprised of limited amounts of sulfur-containing organic compounds as unwanted impurities. The processes involve integrated, multistage processes which include pretreatment of a light naphtha with a solid adsorbent to remove basic nitrogen containing compounds, chemical conversion of one or more of the sulfur-containing impurities to higher boiling products by alkylation, and removing the higher boiling products by fractional distillation. Advantageously, the processes include selective hydrogenation of the high-boiling fraction whereby the incorporation of hydrogen into hydrocarbon compounds, sulfur-containing organic compounds, and/or nitrogen-containing organic compounds assists by hydrogenation removal of sulfur and/or nitrogen. Products can be used directly as transportation fuels and/or blending components to provide, for example, more suitable components for blending into fuels which are more friendly to the environment.

24 Claims, 1 Drawing Sheet

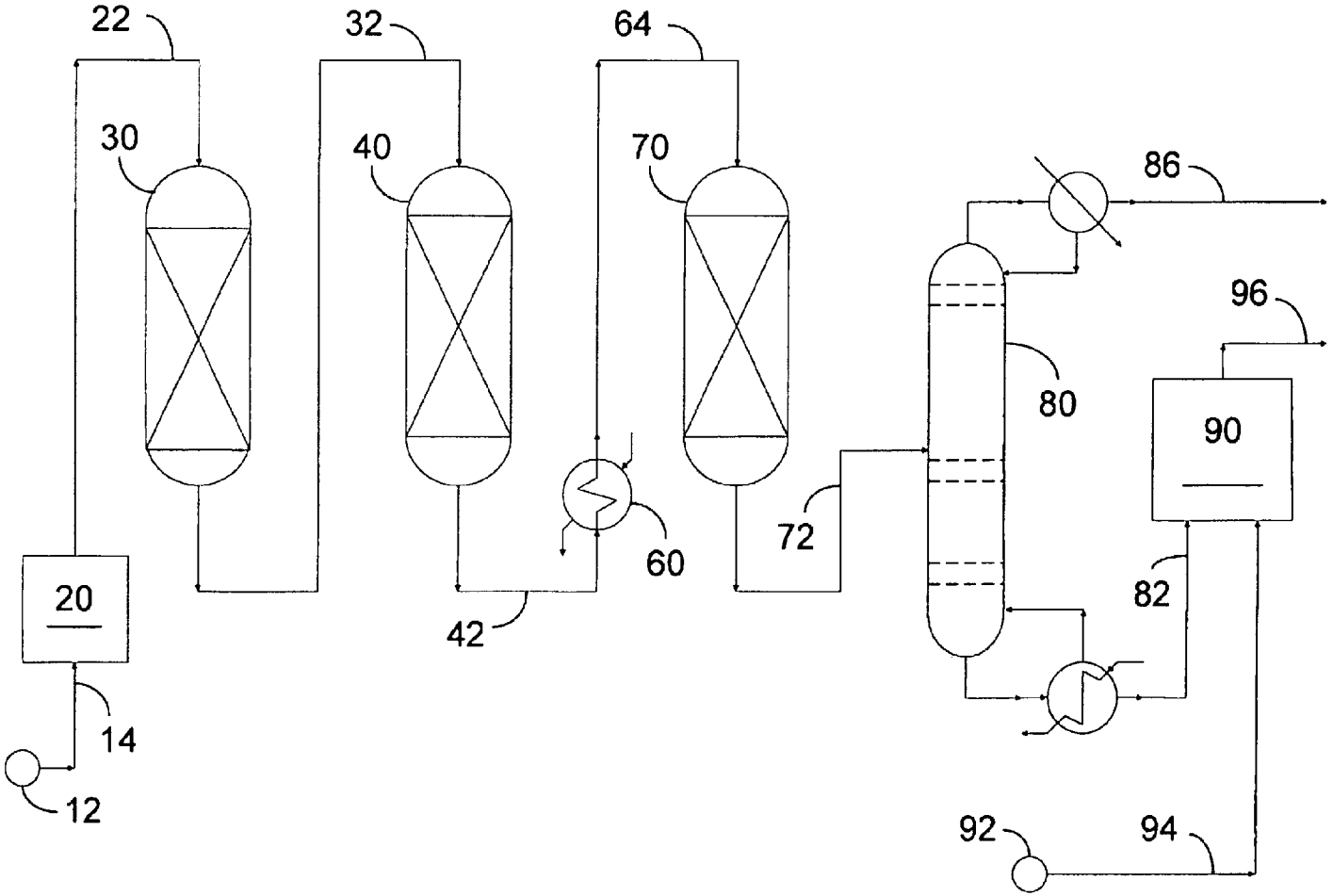
96
90
86
82
94
80
92
72
64
70
60
42
32
40
22
30
20
14
12

MULTISTAGE PROCESS FOR REMOVAL OF SULFUR FROM COMPONENTS FOR BLENDING OF TRANSPORTATION FUELS

TECHNICAL FIELD

The present invention relates to fuels for transportation which are liquid at ambient conditions and typically derived from natural petroleum. Broadly, it relates to integrated, multistage processes for producing products of reduced sulfur content from a feedstock wherein the feedstock is comprised of limited amounts of sulfur-containing organic compounds as unwanted impurities. More particularly, the invention relates to integrated, multistage processes which include treatment of a refinery stream with a solid adsorbent to remove basic nitrogen-containing compounds, chemical conversion of one or more of the sulfur-containing impurities to higher boiling products by alkylation using a first catalyst contacting stage at elevated temperatures and a subsequent catalyst contacting stage at lower elevated temperatures, and removing the higher boiling products by fractional distillation. Integrated processes of this invention advantageously include selective hydrogenation of the high-boiling fraction whereby the incorporation of hydrogen into hydrocarbon compounds, sulfur-containing organic compounds, and/or nitrogen-containing organic compounds assists by hydrogenation removal of sulfur and/or nitrogen. Products can be used directly as transportation fuels and/or blending components to provide fuels which are more friendly to the environment.

BACKGROUND OF THE INVENTION

It is well known that internal combustion engines have revolutionized transportation following their invention during the last decades of the 19th century. While others, including Benz and Gottleib Wilhelm Daimler, invented and developed engines using electric ignition of fuel such as gasoline, Rudolf C. K. Diesel invented and built the engine named for him which employs compression for auto-ignition of the fuel in order to utilize low-cost organic fuels. Equal, if not more important, development of improved spark-ignition engines for use in transportation has proceeded hand-in-hand with improvements in gasoline fuel compositions. Modern high performance gasoline engines demand ever more advanced specification of fuel compositions, but cost remains an important consideration.

At the present time most fuels for transportation are derived from natural petroleum. Indeed, petroleum as yet is the world's main source of hydrocarbons used as fuel and petrochemical feedstock. While compositions of natural petroleum or crude oils are significantly varied, all crudes contain sulfur compounds and most contain nitrogen compounds which may also contain oxygen, but oxygen content of most crudes is low. Generally, sulfur concentration in crude is less than about 8 percent, with most crudes having sulfur concentrations in the range from about 0.5 to about 1.5 percent. Nitrogen concentration is usually less than 0.2 percent, but it may be as high as 1.6 percent.

Crude oil seldom is used in the form produced at the well, but is converted in oil refineries into a wide range of fuels and petrochemical feedstocks. Typically fuels for transportation are produced by processing and blending of distilled fractions from the crude to meet the particular end use specifications. Because most of the crudes available today in large quantity are high in sulfur, the distilled fractions must be desulfurized to yield products which meet performance specifications and/or environmental standards. Sulfur containing organic compounds in fuels continue to be a major source of environmental pollution. During combustion they are converted to sulfur oxides which, in turn, give rise to sulfur oxyacids and, also, contribute to particulate emissions.

In the face of ever-tightening sulfur specifications in transportation fuels, sulfur removal from petroleum feedstocks and products will become increasingly important in years to come. While legislation on sulfur in diesel fuel in Europe, Japan and the U.S. has recently lowered the specification to 0.05 percent by weight (max.), indications are that future specifications may go far below the current 0.05 percent by weight level. Legislation on sulfur in gasoline in the U.S. now limits each refinery to an average of 30 parts per million. In and after 2006 the average specification will be replaced by a cap of 80 parts per million maxim.

The fluidized catalytic cracking process is one of the major refining processes which is currently employed in the conversion of petroleum to desirable fuels such as gasoline and diesel fuel. In this process, a high molecular weight hydrocarbon feedstock is converted to lower molecular weight products through contact with hot, finely-divided, solid catalyst particles in a fluidized or dispersed state. Suitable hydrocarbon feedstocks typically boil within the range of 205° C. to about 650° C., and they are usually contacted with the catalyst at temperatures in the range 450° C. to about 650° C. Suitable feedstocks include various mineral oil fractions such as light gas oils, heavy gas oils, wide-cut gas oils, vacuum gas oils, kerosenes, decanted oils, residual fractions, reduced crude oils and cycle oils which are derived from any of these as well as fractions derived from shale oils, tar sands processing, and coal liquefaction. Products from a fluidized catalytic cracking process are typically based on boiling point and include light naphtha (boiling between about 10° C. and about 221° C.), heavy naphtha (boiling between about 10° C. and about 249° C.), kerosene (boiling between about 180° C. and about 300° C.), light cycle oil (boiling between about 221° C. and about 345° C.), and heavy cycle oil (boiling at temperatures higher than about 345° C.).

Not only does the fluidized catalytic cracking process provide a significant part of the gasoline pool in the United States, it also provides a large proportion of the sulfur that appears in this pool. The sulfur in the liquid products from this process is in the form of organic sulfur compounds and is an undesirable impurity which is converted to sulfur oxides when these products are utilized as a fuel. These sulfur oxides are objectionable air pollutants. In addition, they can deactivate many of the catalysts that have been developed for the catalytic converters which are used on automobiles to catalyze the conversion of harmful engine exhaust emissions to gases which are less objectionable. Accordingly, it is desirable to reduce the sulfur content of catalytic cracking products to the lowest possible levels.

The sulfur-containing impurities of straight run gasolines, which are prepared by simple distillation of crude oil, are usually very different from those in cracked gasolines. The former contain mostly mercaptans and sulfides, whereas the latter are rich in thiophene, benzothiophene and derivatives of thiophene and benzothiophene.

Low sulfur products are conventionally obtained from the catalytic cracking process by hydrotreating either the feedstock to the process or the products from the process. Hydrotreating involves treatment of products of the cracking process with hydrogen in the presence of a catalyst and results in the conversion of the sulfur in the sulfur-containing impurities to hydrogen sulfide, which can be separated and converted to elemental sulfur. Unfortunately, this type of processing is typically quite expensive because it requires a source of hydrogen, high pressure process equipment, expensive hydrotreating catalysts, and a sulfur recovery plant for conversion of the resulting hydrogen sulfide to elemental sulfur. In addition, the hydrotreating process can result in an undesired destruction of olefins in the feedstock by converting them to saturated hydrocarbons through hydrogenation. This destruction of olefins by hydrogenation is usually undesirable because it results in the consumption of expensive hydrogen, and also because the olefins are valuable as high octane components of gasoline. As an example, naphtha of a gasoline boiling range from a catalytic cracking process has a relatively high octane number as a result of a large olefin content. Hydrotreating such a material causes a reduction in the olefin content in addition to the desired desulfurization, and the octane number of the hydrotreated product decreases as the degree of desulfurization increases.

Conventional hydrodesulfurization catalysts can be used to remove a major portion of the sulfur from petroleum distillates for the blending of refinery transportation fuels, but they are not efficient for removing sulfur from compounds where the sulfur atom is sterically hindered as in multi-ring aromatic sulfur compounds. This is especially true where the sulfur heteroatom is doubly hindered (e.g., 4,6-dimethyldibenzothiophene). Using conventional hydrodesulfurization catalysts at high temperatures would cause yield loss, faster catalyst coking, and product quality deterioration (e.g., color). Using high pressure requires a large capital outlay. Accordingly, there is a need for an inexpensive process for the effective removal of sulfur-containing impurities from distillate hydrocarbon liquids. There is also a need for such a process which can be used to remove sulfur-containing impurities from distillate hydrocarbon liquids, such as products from a fluidized catalytic cracking process, which are highly olefinic and contain both thiophenic and benzothiophenic compounds as unwanted impurities.

In order to meet stricter specifications in the future, such hindered sulfur compounds will also have to be removed from distillate feedstocks and products. There is a pressing need for economical removal of sulfur from refinery fuels for transportation, especially from components for gasoline.

The art is replete with processes said to remove sulfur from distillate feedstocks and products. For example, U.S. Pat. No. 6,087,544 in the name of Robert J. Wittenbrink, Darryl P. Klein, Michele S Touvelle, Michel Daage and Paul J. Berlowitz relates to processing a distillate feedstream to produce distillate fuels having a level of sulfur below the distillate feedstream. Such fuels are produced by fractionating a distillate feedstream into a light fraction, which contains only from about 50 to 100 ppm of sulfur, and a heavy fraction. The light fraction is hydrotreated to remove substantially all of the sulfur therein. The desulfurized light fraction, is then blended with one half of the heavy fraction to product a low sulfur distillate fuel, for example 85 percent by weight of desulfurized light fraction and 15 percent by weight of untreated heavy fraction reduced the level of sulfur from 663 ppm to 310 ppm. However, to obtain this low sulfur level only about 85 percent of the distillate feedstream is recovered as a low sulfur distillate fuel product.

U.S. Pat. No. 2,448,211, in the name of Philip D. Caesar, et al. states that thiophene and its derivatives can be alkylated by reaction with olefinic hydrocarbons at a temperature between about 140° and about 400° C. in the presence of a catalyst such as an activated natural clay or a synthetic adsorbent composite of silica and at least one amphoteric metal oxide. Suitable activated natural clay catalysts include clay catalysts on which zinc chloride or phosphoric acid have been precipitated. Suitable silica-amphoteric metal oxide catalysts include combinations of silica with materials such as alumina, zirconia, ceria, and thoria. U.S. Pat. No. 2,469,823, in the name of Rowland C. Hansford and Philip D. Caesar teaches that boron trifluoride can be used to catalyze the alkylation of thiophene and alkyl thiophenes with alkylating agents such as olefinic hydrocarbons, alkyl halides, alcohols, and mercaptans. In addition, U.S. Pat. No. 2,921,081, in the name of (Zimmerschied et al.) discloses that acidic solid catalysts can be prepared by combining a zirconium compound selected from the group consisting of zirconium dioxide and the halides of zirconium with an acid selected from the group consisting of ortho-phosphoric acid, pyrophosphoric acid, and triphosphoric acid. The Zimmerschied et al. reference also teaches that thiophene can be alkylated with propylene at a temperature of 227° C. in the presence of such a catalyst.

U.S. Pat. No. 2,563,087 in the name of Jerome A. Vesely states that thiophene can be removed from aromatic hydrocarbons by selective alkylation of the thiophene and separation of the resulting thiophene alkylate by distillation. The selective alkylation is carried out by mixing the thiophene-contaminated aromatic hydrocarbon with an alkylating agent and contacting the mixture with an alkylation catalyst at a carefully controlled temperature in the range from about −20° C. to about 85° C. It is disclosed that suitable alkylating agents include olefins, mercaptans, mineral acid esters, and alkoxy compounds such as aliphatic alcohols, ethers and esters of carboxylic acids. It is also disclosed that suitable alkylation catalysts include the following: (1) the Friedel-Crafts metal halides, which are preferably used in anhydrous form; (2) a phosphoric acid, preferably pyrophosphoric acid, or a mixture of such a material with sulfuric acid in which the volume ratio of sulfuric to phosphoric acid is less than about 4:1; and (3) a mixture of a phosphoric acid, such as ortho-phosphoric acid or pyrophosphoric acid, with a siliceous adsorbent, such as kieselguhr or a siliceous clay, which has been calcined to a temperature of from about 400° to about 500° C. to form a silico-phosphoric acid combination which is commonly referred to as a solid phosphoric acid catalyst.

U.S. Pat. No. 3,894,941 in the name of Paul G. Bercik and Kirk J. Metzger describes a method for converting mercaptans to alkyl sulfides, sweet organic sulfides, by contacting the mercaptan-containing hydrocarbon feed having from 3 to 12 carbon atoms per molecule and free of hydrogen sulfide, with a tertiary olefin of a select group, in the presence of a catalyst comprising Group VI-B or Group VIII metals and a support consisting of semi-crystalline aluminosilicates and amorphous silica-aluminas. The patent states that concentrations of tertiary olefin in the conversion zone are in the range of 0.1 to 20 liquid volume percent. While the product is said to be substantially free of mercaptans, the level of elemental sulfur his not been reduced by this method.

U.S. Pat. No. 4,775,462 in the name of Tamotsu Imai and Jeffery C. Bricker describes a method a non-oxidative method of sweetening a sour hydrocarbon fraction whereby mercaptans are converted to thioethers which are said to be acceptable in fuels. The method involves contacting a mercaptan-containing hydrocarbon fraction with a catalyst consisting of an acidic inorganic oxide, a polymeric sulfonic acid resin, an intercalate compound, a solid acid catalyst, a boron halide dispersed on alumina, or an aluminum halide dispersed on alumina, in the presence of an unsaturated hydrocarbon equal to the molar amount of mercaptans, typically from about 0.01 weight percent to bout 20 weight percent. While the product is said to be substantially free of mercaptans, the level of elemental sulfur his not been reduced by this process.

U.S. Pat. No. 5,171,916 in the name of Quany N. Le and Michael S. Sarli describes a process for upgrading a light cycle oil by: (A) alkylating the heteroatom containing aromatics of the cycle oil with an aliphatic hydrocarbon having 14 to 24 carbon atoms and at least one olefinic double bond through the use of a crystalline metallosilicate catalyst; and (B) separating the high boiling alkylation product in the lubricant boiling range from the unconverted light cycle oil by fractional distillation. It also states that the unconverted light cycle oil has a reduced sulfur and nitrogen content, and the high boiling alkylation product is useful as a synthetic alkylated aromatic lubricant base stock.

U.S. Pat. No. 5,599,441 in the name of Nick A. Collins and Jeffrey C. Trewella describes a process for removing thiophenic sulfur compounds from a cracked naphtha by: (A) contacting the naphtha with an acid catalyst to alkylate the thiophenic compounds using the olefins present in the naphtha as an alkylating agent; (B) removing an effluent stream from the alkylation zone; and (C) separating the alkylated thiophenic compounds from the alkylation zone effluent stream by fractional distillation. It also states that additional olefins can be added to the cracked naphtha to provide additional alkylating agent for the process.

More recently, U.S. Pat. No. 6,024,865 in the name of Bruce D. Alexander, George A. Huff, Vivek R. Pradhan, William J. Reagan and Roger H. Cayton disclosed a product of reduced sulfur content which is produced from a feedstock which is comprised of a mixture of hydrocarbons and includes sulfur-containing aromatic compounds as unwanted impurities. The process involves separating the feedstock by fractional distillation into a lower boiling fraction which contains the more volatile sulfur-containing aromatic impurities and at least one higher boiling fraction which contains the less volatile sulfur-containing aromatic impurities. Each fraction is then separately subjected to reaction conditions which are effective to convert at least a portion of its content of sulfur-containing aromatic impurities to higher boiling sulfur-containing products by alkylation with an alkylating agent in the presence of an acidic catalyst. The higher boiling sulfur-containing products are removed by fractional distillation. It is also stated that alkylation can be achieved in stages with the proviso that the conditions of alkylation are less severe in the initial alkylation stage than in a secondary stage, e.g., through the use of a lower temperature in the first stage as opposed to a higher temperature in a secondary stage.

U.S. Pat. No. 6,059,962 in the name of Bruce D. Alexander, George A. Huff, Vivek R. Pradhan, William J. Reagan and Roger H. Clayton disclosed A product of reduced sulfur content is produced in a multiple stage process from a feedstock which is comprised of a mixture of hydrocarbons and includes sulfur-containing aromatic compounds as unwanted impurities. The first stage involves: (1) subjecting the feedstock to alkylation conditions which are effective to convert a portion of the impurities to higher boiling sulfur-containing products, and (2) separating the resulting products by fractional distillation into a lower boiling fraction and a higher boiling fraction. The lower boiling fraction is comprised of hydrocarbons and is of reduced sulfur content relative to the feedstock. The higher boiling fraction is comprised of hydrocarbons and contains unconverted sulfur-containing aromatic impurities and also the higher boiling sulfur-containing products. Each subsequent stage involves: (1) subjecting the higher boiling fraction from the preceding stage to alkylation conditions which are effective to convert at least a portion of its content of sulfur-containing aromatic compounds to higher boiling sulfur-containing products, and (2) separating the resulting products by fractional distillation into a lower boiling hydrocarbon fraction and a higher boiling fraction which contains higher boiling sulfur-containing alkylation products. The total hydrocarbon product of reduced sulfur content from the process is comprised of the lower boiling fractions from various stages. Again it is stated that alkylation can be achieved in stages with the proviso that the conditions of alkylation are less severe in the initial alkylation stage than in a secondary stage, e.g., through the use of a lower temperature in the first stage a opposed to a higher temperature in a secondary stage.

There is, therefore, a present need for catalytic processes to prepare products of reduced sulfur content from a feedstock wherein the feedstock is comprised of limited amounts of sulfur-containing and/or nitrogen-containing organic compounds as unwanted impurities, in particular, processes which do not have the above disadvantages. A further object of the invention is to provide inexpensive processes for the efficient removal of impurities from a hydrocarbon feedstock.

An improved process should be an integrated sequence, carried out in the liquid phase using a suitable alkylation-promoting catalyst system, preferably an alkylation catalyst capable of enhancing the incorporation olefins into sulfur-containing organic compounds thereby assisting the removal of sulfur or nitrogen from a mixture of organic compounds suitable as blending components for refinery transportation fuels liquid at ambient conditions.

Advantageously, an improved desulfurization process shall minimize formation of unwanted co-products, such as formation undesired oligomers and polymers from the polymerization of olefinic alkylating agents. Beneficially, an improved desulfurization process shall efficiently remove sulfur-containing impurities from an olefinic cracked naphtha, but does not significantly reduce the octane rating of the naphtha.

This invention is directed to overcoming the problems set forth above in order to provide components for refinery blending of transportation fuels friendly to the environment.

SUMMARY OF THE INVENTION

Economical processes are disclosed for the production of components for refinery blending of transportation fuels by integrated, multistage processes which include treatment of a light refinery stream with a solid adsorbent to remove basic nitrogen containing compounds, chemical conversion of one or more of the sulfur-containing impurities to higher boiling products through alkylation by olefins, and beneficially removing the higher boiling products by fractional distillation. This invention contemplates the treatment of various type hydrocarbon materials, especially hydrocarbon oils of petroleum origin which contain sulfur. In general, the sulfur contents of the oils are in excess of 1 percent, and range up to about 2 or 3 percent. Processes of the invention are particularly suitable for treatment of a refinery feedstream comprised of gasoline, kerosene, light naphtha, heavy naphtha, and light cycle oil, and preferably a naphtha from catalytic and/or thermal cracking processes.

Multistage sulfur removal processes of the invention involve the advantageous use of an alkylation catalyst in an initial alkylation zone, at least one subsequent alkylation zone which is operated at less severe conditions than the initial alkylation zone, and thereafter as the solid adsorbent to remove basic nitrogen-containing compounds from feed to the initial alkylation zone. Beneficially, the products formed contain organic sulfur compounds of higher molecular weight than corresponding mercaptans, sulfides and sulfur-containing aromatics, such as thiophenic and benzothiophenic compounds, in the feedstock.

In one aspect, this invention provides a process for the production of products which are liquid at ambient conditions and contain organic sulfur compounds of higher molecular weight than corresponding sulfur-containing compounds in the feedstock, which process comprises; (a) providing a feedstock comprising a mixture of hydrocarbons which includes olefins, and sulfur-containing organic compounds and nitrogen-containing organic compounds, the feedstock consisting essentially of material boiling between about 60° C. and about 345° C. and having a sulfur content up to about 4,000 or 5,000 parts per million and a nitrogen content up to about 2,000 parts per million, (b) passing the feedstock through a bed of solid adsorbent, under conditions suitable for adsorption within the bed, to effect selective adsorption and/or complexing of at least a portion of the contained nitrogen-containing organic compounds with the adsorbent, and thereby obtain effluent from the bed which contains less of nitrogen-containing organic compounds than the feedstock, (c) in a first contacting stage at elevated temperatures, contacting the effluent with an acidic catalyst under conditions which are effective to convert a portion of the impurities to a sulfur-containing material of higher molecular weight through alkylation by the olefins, thereby forming an initial product stream, and (d) in a subsequent contacting stage and at temperatures at least 10° C. lower than an average of the elevated temperatures in the first contacting stage, contacting at least a portion of the initial product stream with an acidic catalyst under conditions which are effective to convert a portion of the impurities to a sulfur-containing material of higher molecular weight through alkylation by the olefins, thereby forming a subsequent product stream.

In another aspect, this invention provides a process for the production of products which are liquid at ambient conditions and have a reduced sulfur content relative to the feedstock, which process comprises; (a) providing a feedstock comprising a mixture of hydrocarbons which includes olefins and sulfur-containing organic compounds, the feedstock consisting essentially of material boiling between about 60° C. and about 345° C. and having a sulfur content up to about 5,000 parts per million, (b) passing the feedstock through a bed of solid adsorbent, under conditions suitable for adsorption within the bed, to effect selective adsorption and/or complexing of at least a portion of the contained nitrogen-containing organic compounds with the adsorbent, and thereby obtain effluent from the bed which contains less of nitrogen-containing organic compounds than the feedstock, (c) in a first contacting stage at elevated temperatures, contacting the feedstock with an acidic catalyst under conditions which are effective to convert a portion of the impurities to a sulfur-containing material of higher boiling point through alkylation by the olefins, thereby forming an initial product stream, (d) in a subsequent contacting stage and at temperatures at least 10° C. lower than an average of the elevated temperatures in the initial contacting stage, contacting at least a portion of the initial product stream with an acidic catalyst under conditions which are effective to convert a portion of the impurities to a sulfur-containing material of higher boiling point through alkylation by the olefins, thereby forming a subsequent product stream, and (e) fractionating the subsequent product stream by distillation to provide (i) at least one low-boiling fraction consisting of a sulfur-lean, fraction having a sulfur content less than about 50 parts per million, and (ii) a high-boiling fraction consisting of a sulfur-rich, fraction containing the balance of the sulfur. In preferred embodiments of invention the multistage process provides a low-boiling fraction which has a sulfur content of less than about 30 parts per million. More preferred are embodiments which provide products which have a sulfur content of less than about 15 parts per million, and most preferably less than about 10 parts per million.

Other aspects of the invention include compositions formed by any process disclosed herein. Such compositions have a sulfur content of less than about 50 parts per million, preferably less than about 30 parts per million, more preferably have a sulfur content of less than about 15 parts per million, and most preferably less than about 10 parts per million.

Suitable feedstocks include products of refinery cracking processes which consists essentially of material boiling between about 200° C. and about 425° C. Preferably such refinery stream consisting essentially of material boiling between about 220° C. and about 400° C., and more preferably boiling between about 275° C. and about 375° C. Where the selected feedstock is a naphtha from a refinery cracking process, the feedstock consists essentially of material boiling between about 20° C. and about 250° C. Preferably the feedstock is a naphtha stream consisting essentially of material boiling between about 40° C. and about 225° C., and more preferably boiling between about 60° C. and about 200° C.

Beneficially for processes of the invention the feedstock is comprised of a treated naphtha which is prepared by removing basic nitrogen-containing impurities from a naphtha produced by a catalytic cracking process. Preferably, the olefin content of the feedstock is at least equal on a molar basis to that of the sulfur-containing organic compounds.

According to the invention, the acidic catalyst of initial contacting stage is the same or different from that of the subsequent contacting stage. Advantageously a solid phosphoric acid catalyst is used as the acidic catalyst in at least one of the contacting stages. According to preferred embodiments of the invention, the acidic catalyst of the subsequent contacting stage is comprised of a material which is prepared from an acidic catalyst by use in the first contacting stage, and the solid adsorbent is comprised of a material which is prepared from the acidic catalyst by use in the first contacting stage and/or the subsequent contacting stage. More preferably a solid phosphoric acid catalyst is used as the acidic catalyst in the initial contacting stage at elevated temperatures, thereafter as the acidic catalyst of the subsequent contacting stage at less severe conditions for alkylation, and finally as the solid adsorbent to remove basic nitrogen-containing compounds from feed to the initial alkylation zone.

Beneficially the temperatures used in the subsequent contacting stage are at least 5° C. lower than an average of the elevated temperatures in the initial contacting stage.

The temperature differential between the initial alkylation stage and the subsequent stage preferably is in a range of from about negative 5° C. to about negative 115° C., more preferably in a range from about negative 15° C. to about negative 75° C. Where a solid phosphoric acid catalyst is used as the acidic catalyst in at least one of the contacting stages, the temperatures used in the subsequent contacting stage is preferably at least 25° C. lower than an average of the elevated temperatures in the initial contacting stage, and more preferably at least 45° C. lower.

In one aspect of this invention the elevated temperatures used in the initial contacting stage are in a range from about 120° C. to about 250° C. Where a solid phosphoric acid catalyst is used as the acidic catalyst in an initial contacting stage, the elevated temperatures are preferably in a range of temperature from about 140° C. to about 220° C., and more preferably in a range from about 160° C. to about 190° C. Where a solid phosphoric acid catalyst is used as the acidic catalyst in both stages of contacting, the temperatures in the subsequent stage are preferably in a range of temperature from about 90° C. to about 250° C., preferably at temperatures in a range from about 100° C. to about 235° C., and more preferably at temperatures in a range from about 110° C. to about 220° C.

In one aspect of this invention the temperature cut-point in distillation step separating the low-boiling fraction and the high-boiling fraction is in the range from about 70° C. to about 200° C., and preferably in the range from about 150° C. to about 190° C. Advantageously, the high-boiling fraction has a distillation end point which is below about 249° C.

In another aspect, this invention provides one low-boiling fraction having a distillation end point and a high-boiling fraction having an initial boiling point such that the distillation end point and the initial boiling point are in the range from about 80° C. to about 220° C.

In yet another aspect, this invention provides a process for the production of products which are liquid at ambient conditions and have a reduced sulfur content relative to the feedstock, which process comprises; (a) providing a feedstock comprising a mixture of hydrocarbons which includes olefins and sulfur-containing organic compounds, the feedstock consisting essentially of material boiling between about 60° C. and about 345° C. and having a sulfur content up to about 4,000 or 5,000 parts per million, (b) passing the feedstock through a bed of solid adsorbent, under conditions suitable for adsorption within the bed, to effect selective adsorption and/or complexing of at least a portion of the contained nitrogen-containing organic compounds with the adsorbent, and thereby obtain effluent from the bed which contains less of nitrogen-containing organic compounds than the feedstock, (c) in a first contacting stage at elevated temperatures, contacting the feedstock with an acidic catalyst under conditions which are effective to convert a portion of the impurities to a sulfur-containing material of higher boiling point through alkylation by the olefins, thereby forming an initial product stream, (d) in a subsequent contacting stage and at temperatures at least 10° C. lower than an average of the elevated temperatures in the initial contacting stage, contacting at least a portion of the initial product stream with an acidic catalyst under conditions which are effective to convert a portion of the impurities to a sulfur-containing material of higher boiling point through alkylation by the olefins, thereby forming a subsequent product stream, (e) fractionating the subsequent product stream by distillation to provide at least one low-boiling fraction consisting of a sulfur-lean, mono-aromatic-rich fraction having a sulfur content less than about 50 parts per million, and a high-boiling fraction consisting of a sulfur-rich, mono-aromatic-lean fraction containing the balance of the sulfur, (g) treating the high-boiling fraction with a gaseous source of dihydrogen at hydrogenation conditions in the presence of a hydrogenation catalyst which exhibits a capability to enhance the incorporation of hydrogen into one or more of the sulfur-containing organic compounds and under conditions suitable for hydrogenation of one or more of the sulfur-containing organic compounds, and (g) recovering a high-boiling liquid having a sulfur content less than about 50 parts per million, and is substantially free hydrogen sulfide. Advantageously, all or a portion of the a high-boiling liquid substantially free hydrogen sulfide is blended with at least one low-boiling fraction of the distillation.

In a further aspect of this invention, the hydrotreating of the petroleum distillate employs at least one bed of hydrogenation catalyst comprising one or more metals selected from the group consisting of cobalt, nickel, molybdenum and tungsten.

Advantageously, the contacting the high-boiling feedstock with a gaseous source of dihydrogen employs at least one bed of hydrogenation catalyst comprising one or more metals selected from the group consisting of nickel, molybdenum and tungsten.

Generally, useful hydrogenation catalysts comprise at least one active metal, selected from the d-transition elements in the Periodic Table, each incorporated onto an inert support in an amount of from about 0.1 percent to about 30 percent by weight of the total catalyst. Suitable active metals include the d-transition elements in the Periodic Table elements having atomic number in from 21 to 30, 39 to 48, and 72 to 78.

Useful catalyst for the hydrotreating comprise a component capable to enhance the incorporation of hydrogen into a mixture of organic compounds to thereby form at least hydrogen sulfide, and a catalyst support component. The catalyst support component typically comprises a refractory inorganic oxide such as silica, alumina, or silica-alumina. Refractory inorganic oxides, suitable for use in the present invention, preferably have a pore diameter ranging from about 50 to about 200 Angstroms, and more preferably from about 80 to about 150 Angstroms for best results. Advantageously, the catalyst support component comprises a refractory inorganic oxide such as alumina.

Hydrotreating of the refinery distillate preferably employs at least one bed of hydrogenation catalyst comprising cobalt and one or more metals selected from the group consisting of nickel, molybdenum and tungsten, each incorporated onto an inert support in an amount of from about 0.1 percent to about 20 percent by weight of the total catalyst.

Contacting of the high-boiling fraction with a gaseous source of dihydrogen preferably employs at least one bed of hydrogenation catalyst comprising nickel and one or more metals selected from the group consisting of, molybdenum and tungsten, each incorporated onto an inert support in an amount of from about 0.1 percent to about 20 percent by weight of the total catalyst.

This invention is particularly useful towards sulfur-containing organic compounds in the oxidation feedstock which includes compounds in which the sulfur atom is sterically hindered, as for example in multi-ring aromatic sulfur compounds. Typically, the sulfur-containing organic compounds include at least sulfides, heteroaromatic sulfides, and/or compounds selected from the group consisting of substituted benzothiophenes and dibenzothiophenes.

Hydrogenation catalysts beneficially contain a combination of metals. Preferred are hydrogenation catalysts containing at least two metals selected from the group consisting of cobalt, nickel, molybdenum and tungsten. More preferably, co-metals are cobalt and molybdenum or nickel and molybdenum. Advantageously, the hydrogenation catalyst comprises at least two active metals, each incorporated onto a metal oxide support, such as alumina in an amount of from about 0.1 percent to about 20 percent by weight of the total catalyst.

For a more complete understanding of the present invention reference should now be made to the embodiments illustrated in greater detail in the accompanying drawing and described below by way of examples of the invention.

BRIEF DESCRIPTION OF THE DRAWING

The drawing is a schematic flow diagram depicting a preferred aspect of the present invention for continuous production of components for blending of transportation fuels which are liquid at ambient conditions. Elements of the invention in this schematic flow diagram include sequential pretreatment of a light naphtha with an acetic liquid and thereafter a solid adsorbent to remove basic nitrogen containing compounds, alkylating the treated naphtha in a series of two alkylation reactors at successively less severe conditions, and fractionating the alkylate to provide a low-boiling blending component consisting of a sulfur-lean fraction, and a high-boiling, sulfur-rich fraction. This high-boiling fraction is further treated by a process which comprises reacting the high-boiling fraction with a source of dihydrogen (molecular hydrogen) at hydrogenation conditions in the presence of a hydrogenation catalyst to assist by hydrogenation removal of sulfur and/or nitrogen from the hydrotreated fraction.

GENERAL DESCRIPTION

Suitable feedstocks for used in this invention are derived from petroleum distillates which generally comprise most refinery streams consisting substantially of hydrocarbon compounds which are liquid at ambient conditions. Petroleum distillates are liquids which boil over either a broad or a narrow range of temperatures within the range from about 10° C. to about 345° C. However, such liquids are also encountered in the refining of products from coal liquefaction and the processing of oil shale or tar sands. These distillate feedstocks can range as high as 2.5 percent by weight elemental sulfur but generally range from about 0.1 percent by weight to about 0.9 percent by weight elemental sulfur. The higher sulfur distillate feedstocks are generally virgin distillates derived from high sulfur crude, coker distillates, and catalytic cycle oils from fluid catalytic cracking units processing relatively higher sulfur feedstocks. Nitrogen content of distillate feedstocks in the present invention is also generally a function of the nitrogen content of the crude oil, the hydrogenation capacity of a refinery per barrel of crude capacity, and the alternative dispositions of distillate hydrogenation feedstock components. The higher nitrogen distillate feedstocks are generally coker distillate and the catalytic cycle oils. These distillate feedstocks can have total nitrogen concentrations ranging as high as 2000 parts per million, but generally range from about 5 parts per million to about 900 parts per million.

Suitable refinery streams generally have an API gravity ranging from about 10° API to about 100° API, preferably from about 10° API to about 75 or 100° API, and more preferably from about 15° API to about 50° API for best results. These streams include, but are not limited to, fluid catalytic process naphtha, fluid or delayed process naphtha, light naphtha, hydrocracker naphtha, hydrotreating process naphthas, isomerate, and catalytic reformate, and combinations thereof. Catalytic reformate and catalytic cracking process naphthas can often be split into narrower boiling range streams such as light and heavy catalytic naphthas and light and heavy catalytic reformate, which can be specifically customized for use as a feedstock in accordance with the present invention. The preferred streams are light virgin naphtha, catalytic cracking naphthas including light and heavy catalytic cracking unit naphtha, catalytic reformate including light and heavy catalytic reformate and derivatives of such refinery hydrocarbon streams.

While the multistage sulfur removal processes of the invention which involve the use of an initial alkylation zone and at least one subsequent alkylation zone which is operated at less sever conditions than the initial alkylation zone, are quite effective, they are better for some petroleum distillates than with others. For example, when applied to a petroleum distillate which contains a significant amount of aromatic hydrocarbons, such as a naphtha from a catalytic cracking process, alkylation of aromatic hydrocarbons in the naphtha is a reaction which competes with the desired alkylation of sulfur-containing impurities. This competing alkylation of aromatic hydrocarbons is ordinarily undesirable because a significant portion of the alkylated aromatic hydrocarbon products will have undesirable high boiling points and will be rejected by the process together with the high boiling point alkylated sulfur-containing impurities. Fortunately, many typical sulfur-containing impurities are alkylated more rapidly than aromatic hydrocarbons. Accordingly, the sulfur-containing impurities can, to a limited degree, be selectively alkylated. However, the competing alkylation of aromatic hydrocarbons makes it essentially impossible to achieve a substantially complete removal of the sulfur-containing impurities without a simultaneous and undesired removal of significant amounts of aromatic hydrocarbons.

In aspects of the invention where an olefin or a mixture of olefins is used as the alkylating agent, olefin polymerization will also compete, as an undesired side reaction, with the desired alkylation of sulfur-containing impurities. As a consequence of this competing reaction, it is frequently not possible to achieve high conversion of the sulfur-containing impurities to alkylation products without a significant conversion of olefinic alkylating agent to polymeric co-products. Such a loss of olefins can be very undesirable as, for example, when an olefinic naphtha of gasoline boiling range is to be desulfurized and the resulting product used as a gasoline blending stock. In this case, olefins having from about 6 to about 10 carbon atoms, which olefins are of high octane and in the gasoline boiling range, can be converted to high-boiling polymeric by-products under severe alkylation conditions and thereby lost as gasoline components.

More suitable feedstocks for used in this invention include any of the various complex mixtures of hydrocarbons derived from refinery distillate steams which generally boil in a temperature range from about 50° C. to about 425° C. Generally such feedstock are comprised of a mixture of hydrocarbons, but contain a minor amount of sulfur-containing organic impurities including aromatic impurities such as thiophenic compounds and benzothiophenic compounds. Preferred feedstocks have an initial boiling point which is below about 79° C. and have a distillation endpoint which is about 345° C. or lower, and more preferably about 249° C. or lower. If desired, the feedstock can have a distillation endpoint of about 221° C. or lower.

It is also anticipated that one or more of the above distillate steams can be combined for use as a feedstock. In many cases performance of the refinery transportation fuel or blending components for refinery transportation fuel obtained from the various alternative feedstocks may be comparable. In these cases, logistics such as the volume availability of a stream, location of the nearest connection and short term economics may be determinative as to what stream is utilized.

Products of catalytic cracking are highly preferred feedstocks for use in this invention. Feedstocks of this type include liquids which boil below about 345° C., such as light naphtha, heavy naphtha and light cycle oil. However, it will also be appreciated that the entire output of volatile products from a catalytic cracking process can be utilized as a feedstock in the subject invention. Catalytic cracking products are a desirable feedstock because they typically contain a relatively high olefin content, which usually makes it unnecessary to add any additional alkylating agent during the first alkylation stage of the invention. In addition to sulfur-containing organic compounds, such as mercaptans and sulfides, sulfur-containing aromatic compounds, such thiophene, benzothiophene and derivatives of thiophene and benzothiophene, are frequently a major component of the sulfur-containing impurities in catalytic cracking products, and such impurities are easily removed by means of the subject invention. For example, a typical light naphtha from the fluidized catalytic cracking of a petroleum derived gas oil can contain up to about 60 percent by weight of olefins and up to about 0.5 percent by weight of sulfur wherein most of the sulfur will be in the form of thiophenic and benzothiophenic compounds. A preferred feedstock for use in the practice of this invention will be comprised of catalytic cracking products and will be additionally comprised of at least 1 weight percent of olefins. A highly preferred feedstock will be comprised of catalytic cracking products and will be additionally comprised of at least 5 weight percent of olefins. Such feedstocks can be a portion of the volatile products from a catalytic cracking process which is isolated by distillation.

In the practice of this invention, the feedstock will contain sulfur-containing aromatic compounds as impurities. In one embodiment of the invention, the feedstock will contain both thiophenic and benzothiophenic compounds as impurities. If desired, at least about 50% or even more of these sulfur-containing aromatic compounds can be converted to higher boiling sulfur-containing material in the practice of this invention. In one embodiment of the invention, the feedstock will contain benzothiophene, and at least about 50% of the benzothiophene will be converted to higher boiling sulfur-containing material by alkylation and removed by fractionation.

Any acidic material which exhibits a capability to enhance the alkylation of sulfur-containing aromatic compounds by olefins or alcohols can be used as a catalyst in the practice of this invention. Although liquid acids, such as sulfuric acid can be used, solid acidic catalysts are particularly desirable, and such solid acidic catalysts include liquid acids which are supported on a solid substrate. Solid acidic catalysts are generally preferred over liquid catalysts because of the ease with which the feed can be contacted with such a material. For example, feedstream can simply be passed through one or more fixed beds of solid particulate acidic catalyst at a suitable temperature. As desired, different acidic catalysts can be used in the various stages of the invention. For example, the severity of the alkylation conditions can be moderated in the alkylation step of the subsequent stage through the use of a less active catalyst, while a more active catalyst can be used in the alkylation step of the initial stage.

Catalysts useful in the practice of the invention include acidic materials such as catalysts comprised of acidic polymeric resins, supported acids, and acidic inorganic oxides. Suitable acidic polymeric resins include the polymeric sulfonic acid resins which are well-known in the art and are commercially available. Amberlyst® 35, a product produced by Rohm and Haas Co., is a typical example of such a material.

Supported acids which are useful as catalysts include but are not limited to Bronsted acids (examples include phosphoric acid, sulfuric acid, boric acid, HF, fluorosulfonic acid, trifluoro-methanesulfonic acid, and dihydroxyfluoroboric acid) and Lewis acids (examples include $BF_3$, $BCl_3$, $AlCl_3$, $AlBr_3$, $FeCl_2$, $FeCl_3$, $ZnCl_2$, $SbF_5$, $SbCl_5$ and combinations of $AlCl_3$ and HCl) which are supported on solids such as silica, alumina, silica-aluminas, zirconium oxide or clays.

Supported catalysts are typically prepared by combining the desired liquid acid with the desired support and drying. Supported catalysts which are prepared by combining a phosphoric acid with a support are highly preferred and are referred to herein as solid phosphoric acid catalysts. These catalysts are preferred because they are both highly effective and low in cost. U.S. Pat. No. 2,921,081 (Zimmerschied et al.), which is incorporated herein by reference in its entirety, discloses the preparation of solid phosphoric acid catalysts by combining a zirconium compound selected from the group consisting of zirconium oxide and the halides of zirconium with an acid selected from the group consisting of ortho-phosphoric acid, pyrophosphoric acid and triphosphoric acid. U.S. Pat. No. 2,120,702 (Ipatieff et al.), which is incorporated herein by reference in its entirety, discloses the preparation of a solid phosphoric acid catalyst by combining a phosphoric acid with a siliceous material.

British Patent No. 863,539, which is incorporated herein by reference in its entirety, also discloses the preparation of a solid phosphoric acid catalyst by depositing a phosphoric acid on a solid siliceous material such as diatomaceous earth or kieselguhr. When a solid phosphoric acid is prepared by depositing a phosphoric acid on kieselguhr, it is believed that the catalyst contains; (i) one or more free phosphoric acid, i.e., ortho-phosphoric acid, pyrophosphoric acid or triphosphoric acid, and (ii) silicon phosphates which are derived from the chemical reaction of the acid or acids with the kieselguhr. While the anhydrous silicon phosphates are believed to be inactive as an alkylation catalyst, it is also believed that they can be hydrolyzed to yield a mixture of ortho-phosphoric and polyphosphoric acids which are catalytically active. The precise composition of this mixture will depend upon the amount of water to which the catalyst is exposed.

In order to maintain a solid phosphoric acid alkylation catalyst at a satisfactory level of activity when it is used with a substantially anhydrous hydrocarbon feedstock, it is conventional practice to add a small amount of water or an alcohol, such as isopropyl alcohol, to the feedstock to maintain the catalyst at a satisfactory level of hydration. It is believed that the alcohol undergoes dehydration upon contact with the catalyst, and that the resulting water then acts to hydrate the catalyst. If the catalyst contains too little water, it tends to have a very high acidity which can lead to rapid deactivation as a consequence of coking and, in addition, the catalyst will not possess a good physical integrity. Further hydration of the catalyst serves to reduce its acidity and reduces its tendency toward rapid deactivation through coke formation. However, excessive hydration of such a catalyst can cause the catalyst to soften, physically agglomerate and create high pressure drops in fixed bed reactors. Accordingly, there is an optimum level of hydration for a solid phosphoric acid catalyst, and this level of hydration will be a function of the reaction conditions, the substrate, and the alkylating agent.

In preferred embodiments of the invention using solid phosphoric acid catalysts, a hydrating agent in an amount which exhibits a capability to enhance performance of the catalyst is required. Advantageously, the hydrating agent is at least one member of the group consisting of water and alkanols having from about 2 to about 5 carbon atoms. An amount of hydrating agent which provides a water concentration in the feedstock in the range from about 50 to about 1,000 parts per million is generally satisfactory. This water is conveniently provided in the form of an alcohol such as isopropyl alcohol.

Acidic inorganic oxides which are useful as catalysts include but are not limited to aluminas, silica-aluminas, natural and synthetic pillared clays, and natural and synthetic zeolites such as faujasites, mordenites, L, omega, X, Y, beta, and ZSM zeolites. Highly suitable zeolites include beta, Y, ZSM-3, ZSM-4, ZSM-5, ZSM-18, and ZSM-20. Desirably, the zeolites are incorporated into an inorganic oxide matrix material such as a silica-alumina. Indeed, equilibrium cracking catalyst can be used as the acid catalyst in the practice of this invention. Catalysts can comprise mixtures of different materials, such as a Lewis acid (examples include $BF_3$, $BCl_3$, $SbF_5$, and $AlCl_3$), a non-zeolitic solid inorganic oxide (such as silica, alumina and silica-alumina), and a large-pore crystalline molecular sieve (examples include zeolites, pillared clays and aluminophosphates).

In the embodiments of the invention using a solid catalyst, it will desirably be in a physical form which will permit a rapid and effective contacting with the reactants in the process stage wherein it is used. Although the invention is not to be so limited, it is preferred that a solid catalyst be in particulate form wherein the largest dimension of the particles has an average value which is in the range from about 0.1 mm to about 2 cm. For example, substantially spherical beads of catalyst can be used which have an average diameter from about 0.1 mm to about 2 cm. Alternatively, the catalyst can be used in the form of rods which have a diameter in the range from about 0.1 mm to about 1 cm and a length in the range from about 0.2 mm to about 2 cm.

As stated previously, feedstocks used in the practice of this invention will likely contain nitrogen-containing organic compounds as impurities in addition to the sulfur-containing organic impurities. Many of the typical nitrogen-containing impurities are organic bases and, in some instances, can cause deactivation of the acidic catalyst or catalysts of the subject invention. Such deactivation can be prevented by removal of the basic nitrogen-containing impurities before they can contact the acidic catalyst. These basic impurities are most conveniently removed from the feedstock before it is utilized in the initial alkylation stage. A highly preferred feedstock for use in the invention is comprised of a treated naphtha which is prepared by removing basic nitrogen-containing impurities from a naphtha produced by a catalytic cracking process.

Suitable methods which remove the basic nitrogen-containing impurities, typically involve treatment with an acidic material. Such methods include procedures such as washing with an aqueous solution of an acid and the use of a guard bed which is positioned in front of the acidic catalyst. Examples of effective guard beds include but are not limited to A-zeolite, Y-zeolite, L-zeolite, mordenite, fluorided alumina, fresh cracking catalyst, equilibrium cracking catalyst and acidic polymeric resins. Where a guard bed technique is employed, it is often desirable to use two guard beds in such a manner that one guard bed can be regenerated while the other is being used to pretreat the feedstock and protect the acidic catalyst. If a cracking catalyst is utilized to remove basic nitrogen-containing impurities, catalyst can be regenerated in the regenerator of a catalytic cracking unit when it has become deactivated with respect to its ability to remove such impurities. If an acid wash is used to remove basic nitrogen-containing compounds, the feedstock will be treated with an aqueous solution of a suitable acid. Suitable acids for this use include but are not limited to hydrochloric acid, sulfuric acid and acetic acid. The concentration of acid in the aqueous solution is not critical, but is conveniently chosen to be in the range from about 0.1 percent to about 30 percent by weight. For example, a 2 percent by weight solution of sulfuric acid in water can be used to remove basic nitrogen containing compounds from a heavy naphtha from a catalytic cracking process.

In the practice of this invention, the feed to the alkylation step of each stage is contacted with the acidic catalyst at a temperature and for a period of time which are effective to result in the desired degree of conversion of selected sulfur-containing organic impurities to a higher boiling sulfur-containing material. It will be appreciated that the temperature and contact time can be selected in such a way that the alkylation conditions in the alkylation step of the subsequent stage, or stages, of the invention are less severe than in that of the initial stage, and this can be achieved by using a lower temperature and optionally in combination with a shorter contact time in the alkylation step of the subsequent stage. Irrespective of the specific alkylation step of the invention, the contacting temperature will be desirably in excess of about 50° C., preferably in excess of 85° C., and more preferably in excess of 100° C. The contacting will generally be carried out at a temperature in the range from about 50° C. to about 260° C., preferably from about 85° C. to about 220° C., and more preferably from about 100° C. to about 200° C. It will be appreciated, of course, that the optimum temperature will be a function of the acidic catalyst used, the alkylating agent or agents selected, the concentration of alkylating agent or agents, and the nature of the sulfur-containing aromatic impurities that are to be removed.

This invention is an integrated, multistage process for concentrating the sulfur-containing aromatic impurities of a hydrocarbon feedstock into a relatively small volume of high boiling material. As a result of this concentration, the sulfur can be disposed of more easily and at lower cost, and any conventional method can be used for this disposal. For example, this material can be blended into heavy fuels where the sulfur content will be less objectionable. Alternatively, it can be efficiently hydrotreated at relatively low cost because of its reduced volume relative to that of the original feedstock.

The catalytic hydrogenation process may be carried out under relatively mild conditions in a fixed, moving fluidized or ebullient bed of catalyst. Preferably a fixed bed of catalyst is used under conditions such that relatively long periods elapse before regeneration becomes necessary, for example an average reaction zone temperature of from about 200° C. to about 450° C., preferably from about 250° C. to about 400° C., and most preferably from about 275° C. to about 350° C. for best results, and at a pressure within the range of from about 6 to about 160 atmospheres.

A particularly preferred pressure range within which the hydrogenation provides extremely good sulfur removal while minimizing the amount of pressure and hydrogen required for the hydrodesulfurization step are pressures within the range of 20 to 60 atmospheres, more preferably from about 25 to 40 atmospheres.

Generally, the hydrogenation process useful in the present invention begins with a distillate fraction preheating step. The distillate fraction is preheated in feed/effluent heat exchangers prior to entering a furnace for final preheating to a targeted reaction zone inlet temperature. The distillate fraction can be contacted with a hydrogen stream prior to, during, and/or after preheating.

The hydrogen stream can be pure hydrogen or can be in admixture with diluents such as hydrocarbon, carbon monoxide, carbon dioxide, nitrogen, water, sulfur compounds, and the like. The hydrogen stream purity should be at least about 50 percent by volume hydrogen, preferably at least about 65 percent by volume hydrogen, and more preferably at least about 75 percent by volume hydrogen for best results. Hydrogen can be supplied from a hydrogen plant, a catalytic reforming facility or other hydrogen producing process.

The reaction zone can consist of one or more fixed bed reactors containing the same or different catalysts. A fixed bed reactor can also comprise a plurality of catalyst beds. The plurality of catalyst beds in a single fixed bed reactor can also comprise the same or different catalysts.

Since the hydrogenation reaction is generally exothermic, interstage cooling, consisting of heat transfer devices between fixed bed reactors or between catalyst beds in the same reactor shell, can be employed. At least a portion of the heat generated from the hydrogenation process can often be profitably recovered for use in the hydrogenation process. Where this heat recovery option is not available, cooling may be performed through cooling utilities such as cooling water or air, or through use of a hydrogen quench stream injected directly into the reactors. Two-stage processes can provide reduced temperature exotherm per reactor shell and provide better hydrogenation reactor temperature control.

The reaction zone effluent is generally cooled and the effluent stream is directed to a separator device to remove the hydrogen. Some of the recovered hydrogen can be recycled back to the process while some of the hydrogen can be purged to external systems such as plant or refinery fuel. The hydrogen purge rate is often controlled to maintain a minimum hydrogen purity and remove hydrogen sulfide. Recycled hydrogen is generally compressed, supplemented with "make-up" hydrogen, and injected into the process for further hydrogenation.

Liquid effluent of the separator device can be processed in a stripper device where light hydrocarbons can be removed and directed to more appropriate hydrocarbon pools. Preferably the separator and/or stripper device includes means capable of providing effluents of at least one low-boiling liquid fraction and one high-boiling liquid fraction. Liquid effluent and/or one or more liquid fraction thereof is subsequently treated to incorporate oxygen into the liquid organic compounds therein and/or assist by oxidation removal of sulfur or nitrogen from the liquid products. Liquid products are then generally conveyed to blending facilities for production of finished distillate products.

Operating conditions to be used in the hydrogenation process include an average reaction zone temperature of from about 200° C. to about 450° C., preferably from about 250° C. to about 400° C., and most preferably from about 275° C. to about 350° C. for best results.

The hydrogenation process typically operates at reaction zone pressures ranging from about 400 psig to about 2000 psig, more preferably from about 500 psig to about 1500 psig, and most preferably from about 600 psig to about 1200 psig for best results. Hydrogen circulation rates generally range from about 500 SCF/Bbl to about 20,000 SCF/Bbl, preferably from about 2,000 SCF/Bbl to about 15,000 SCF/Bbl, and most preferably from about 3,000 to about 13,000 SCF/Bbl for best results. Reaction pressures and hydrogen circulation rates below these ranges can result in higher catalyst deactivation rates resulting in less effective desulfurization, denitrogenation, and dearomatization. Excessively high reaction pressures increase energy and equipment costs and provide diminishing marginal benefits.

The hydrogenation process typically operates at a liquid hourly space velocity of from about 0.2 $hr^{-1}$ to about 10.0 $hr^{-1}$, preferably from about 0.5 $hr^{-1}$ to about 6.0 $hr^{-1}$, and most preferably from about 2.0 $hr^{-1}$ to about 5.0 $hr^{-1}$ for best results. Excessively high space velocities will result in reduced overall hydrogenation.

In a preferred embodiment of the invention, a petroleum distillate is passed to hydrotreater where is it hydrotreated in the presence of a hydrotreating catalyst to remove heteroatoms, particularly sulfur and to saturate aromatics.

Suitable catalysts for use in hydrotreating the petroleum distillate according to the present invention are any conventional hydrogenation catalyst used in the petroleum and petrochemical industries. A common type of such catalysts are those comprised of at least one active metal each incorporated onto an inert support. Preferably, least one active metal is a Group VIII metal, more preferably a metal is selected from the group consisting of cobalt, nickel and iron, and most preferably a metal is selected from the group consisting of cobalt and nickel. Preferred catalysts are those comprised of at least one Group VIII metal and at least one Group VI metal, preferably selected from the group consisting of molybdenum and tungsten. Preferably each incorporated onto a high surface area support material, such as alumina, silica alumina, and zeolites. The Group VIII metal is typically present in an amount ranging from about 2 percent to about 20 percent, preferably from about 4 percent to about 12 percent based upon the total weight of catalyst. The Group VI metal will typically be present in an amount ranging from about 5 percent to about 50 percent, preferably from about 10 percent to about 40 percent and more preferably from about 20 percent to about 30 percent based upon the total weight of catalyst. It is within the scope of the present invention that more than one type of hydrogenation catalyst be used in the same bed.

Suitable support materials used for catalysts according to the present invention include inorganic refractory materials, e.g., alumina, silica, silicon carbide, amorphous and crystalline silica-aluminas, silica magnesias, alumina-magnesias, boria, titania, zirconia and mixtures and co-gels thereof. Preferred support materials for the catalysts include alumina, amorphous silica-alumina, and the crystalline silica-aluminas, particularly those materials classified as clays or zeolites. The most preferred crystalline silica-aluminas are controlled acidity zeolites which are modified by their method of synthesis, for example by the incorporation of acidity moderators, and post-synthesis modifications such as dealumination.

Further reduction of such heteroaromatic sulfides from a distillate petroleum fraction by hydrotreating would require that the stream be subjected to very severe catalytic hydrogenation in order to convert these compounds into hydrocarbons and hydrogen sulfide ($H_2S$). Typically, the larger any hydrocarbon moiety is, the more difficult it is to hydrogenate the sulfide. Therefore, the residual organo-sulfur compounds remaining after a hydrotreatment are the most tightly substituted sulfides.

In a highly preferred embodiment of this invention sulfur-containing organic compounds are removed from various hydrocarbon products that result from the fluidized catalytic cracking of hydrocarbon feedstocks which contain such impurities. In fluidized catalytic cracking processes, high molecular weight hydrocarbon liquids or vapors are contacted with hot, finely divided, solid catalyst particles, typically in a fluidized bed reactor or in an elongated riser reactor, and the catalyst-hydrocarbon mixture is maintained at an elevated temperature in a fluidized or dispersed state for a period of time sufficient to effect the desired degree of cracking to low molecular weight hydrocarbons of the kind typically present in motor gasoline and distillate fuels.

Conversion of a hydrocarbon feedstock in a fluidized catalytic cracking process is effected by contact with a cracking catalyst in a reaction zone at conversion temperature and at a fluidizing velocity which limits the conversion time to not more than about ten seconds. Conversion temperatures are desirably in the range from about 430° C. to about 700° C. and preferably from about 450° C. to about 650° C. Effluent from the reaction zone, comprising hydrocarbon vapors and cracking catalyst containing a deactivating quantity of carbonaceous material or coke, is then transferred to a separation zone. Hydrocarbon vapors are separated from spent cracking catalyst in the separation zone and are conveyed to a fractionator for the separation of these materials on the basis of boiling point. These volatile hydrocarbon products typically enter the fractionator at a temperature in the range from about 430° C. to about 650° C. and supply all of the heat necessary for fractionation.

During the catalytic cracking of hydrocarbons, non-volatile carbonaceous material or coke is unavoidably deposited on the catalyst. As carbonaceous material builds up on the cracking catalyst, the activity of the catalyst for cracking and the selectivity of the catalyst for producing gasoline blending stocks diminishes. The catalyst can, however, recover a major portion of its original catalytic activity by removal of most of the coke from it. This is carried out by burning the carbonaceous deposits from the catalyst using a gaseous source of dioxygen (molecular oxygen) in a regeneration zone or regenerator. Typically the regeneration gas is derived from air.

A wide variety of process conditions are known to be useful in the practice of the fluidized catalytic cracking process. Where a gas oil feedstock is employed, a throughput ratio, or volume ratio of total feed to fresh feed, can vary from about 1.0 to about 3.0. Conversion level can vary from about 40 percent to about 100 percent where conversion is defined as the percentage reduction of hydrocarbons boiling above 221° C. at atmospheric pressure by formation of lighter materials or coke. The weight ratio of fluidized catalyst to oil in the reactor can vary within the range from about 2 to about 20 so that the fluidized dispersion will have a density in the range from about 15 to about 320 kilograms per cubic meter. Fluidizing velocity can be in the range from about 3.0 to about 30 meters per second.

Suitable hydrocarbon feedstock used in a fluidized catalytic cracking process can contain from about 0.2 to about 6.0 weight percent of sulfur in the form of organic sulfur compounds. Suitable feedstocks include but are not limited to sulfur-containing petroleum fractions such as light gas oils, heavy gas oils, wide-cut gas oils, vacuum gas oils, naphthas, decanted oils, residual fractions and cycle oils derived from any of these as well as sulfur-containing hydrocarbon fractions derived from synthetic oils, coal liquefaction and the processing of oil shale and tar sands. Any of these feedstocks can be employed either singly or in any desired combination.

DESCRIPTION OF THE PREFERRED EMBODIMENTS

In order to better communicate the present invention, still another preferred aspect of the invention is depicted schematically in the drawing. Typically, a gas oil which contains hydrocarbon compounds, sulfur-containing organic compounds, and nitrogen-containing organic compounds as impurities is catalytically cracked in a fluidized catalytic cracking process to obtain added value products such as light naphthas which also contain olefins (alkenes).

Referring now to the schematic flow diagram, a light naphtha from a refinery source 12 is passed through conduit 14 and into pretreatment unit 20. The light naphtha feedstock is comprised of organic compounds which include hydrocarbon compounds, such as paraffins, olefins, naphthenes, aromatics, and the impurities (sulfur-containing organic compounds and nitrogen-containing organic compounds). Advantageously, the light naphtha feedstock also contains an amount of alkenes in the range of from about 10 percent to about 30 percent based upon the total weight of the feedstock. More generally, the amount of alkenes in suitable light naphtha feedstocks may as low as about 5 percent, or as high as about 50 percent.

However, the light naphtha feedstock also contains up to about 2,500 parts per million by weight sulfur, preferably from about 200 parts per million to about 1,000 parts per million by weight sulfur, in the form of sulfur-containing organic compounds which include thiophene, thiophene derivatives, benzothiophene, benzothiophene derivatives, mercaptans, sulfides and disulfides. Typically, feedstock also contains basic nitrogen containing organic compounds as impurities. Advantageously, the amount of basic nitrogen in suitable feedstock is in a range downward from about 30 parts per million to about zero.

At least a portion of the basic nitrogen containing compounds are removed from the light naphtha feedstock through contact with an acidic liquid in pretreatment unit 20, for example using an aqueous solution of sulfuric acid, beneficially under mild contacting conditions which do not cause any significant chemical modification of the hydrocarbon components of the feedstock.

The acid treated light naphtha feedstock from unit 20 passes through conduit 22 and into vessel 30, which contains a bed of solid adsorbent. The feedstock passes through the bed under conditions suitable for adsorption within the bed, to effect selective adsorption and/or complexing of at least a portion of the contained nitrogen-containing organic compounds with the adsorbent, and thereby obtain effluent which contains less of nitrogen-containing organic compounds than the feedstock.

The low nitrogen effluent from vessel 30 passes through conduit 32 and into a first alkylation reactor 40, which contains an acidic catalyst. The low nitrogen effluent is passed through reactor 40, where it contacts the acidic catalyst under reaction conditions which are effective to convert predominately the thiophenic impurities to higher boiling thiophenic materials through alkylation by the olefins. In general, the effective conditions of reaction depend upon the catalyst employed. For embodiments using an acidic catalyst comprising a solid phosphoric acid material in the initial alkylation reactor, the contacting is carried out at temperatures in a range from about 100° C. to about 250° C., preferably at temperatures in a range from about 100° C. to about 235° C., and more preferably at temperatures in a range from about 110° C. to about 220° C.

Effluent from alkylation reactor 40 is transferred through conduit 42 and heat exchanger 60, wherein the temperature of the effluent stream is reduced by a pre-selected amount of at least 5° C. The temperature differential between the initial alkylation stage and the subsequent stage preferably is in a range of from about negative 5° C. to about negative 115° C., more preferably in a range from about negative 15° C. to about negative 75° C.

The effluent stream at the reduced temperature passes from heat exchanger 60, through conduit 64 and into downstream alkylation reactor 70, which contains an acidic catalyst. The effluent stream is passed through reactor 70, where it contacts the acidic catalyst under reaction conditions which are effective to convert predominately the mercaptans and sulfides impurities to higher boiling materials through alkylation by the olefins. In general, the effective conditions of reaction depend upon the catalyst employed. For embodiments using an acidic catalyst comprising a solid phosphoric acid material in the initial alkylation reactor, the contacting is carried out at temperatures preferably in range from about 75° C. to about 200° C., more preferably at temperatures in range from about 90° C. to about 150° C. most preferably at temperatures in range from about 100° C. to about 130° C. for best results.

In order to carry out the desired sequential use of catalyst materials in alkylation reactor 40, alkylation reactor 70, and thereafter as adsorbent in vessel 30, use of a swing vessel (not shown) is contemplated. The basic nitrogen levels in effluent from vessel 30 are monitored. When basic nitrogen levels in the effluent from vessel 30 rise to basic nitrogen levels of feed into vessel 30, the swing vessel containing fresh catalyst is placed in the service illustrated as the initial alkylation reactor 40. The reactor which was illustrated as the initial alkylation reactor is transferred to the service illustrated as the alkylation reactor 70. The reactor which was illustrated as the alkylation reactor 70 is transferred to the service illustrated as vessel 30, which is taken out of service, recharged with fresh catalyst, and used as the subsequent swing vessel.

The alkylated stream passes from alkylation reactor 70, through conduit 72 and into distillation column 80 where the higher boiling sulfur-containing products of the alkylation reactions are separated from a low boiling fraction, which thereby is of reduced sulfur content. The low boiling fraction, which is of reduced sulfur content relative to the sulfur content of the first feedstock fraction and has a distillation endpoint of about 177° C., is withdrawn from distillation column 80 through conduit 86. This low boiling fraction from conduit 86 can be used as a low sulfur gasoline blending stock. Typically, the sulfur content of this low boiling fraction is less than about 50 parts per million, preferably less than about 30 parts per million and more preferably less than about 15 parts per million.

A high boiling fraction, which has an initial boiling point of about 177° C. and contains the high boiling alkylated sulfur-containing material produced in alkylation reactor 70, is withdrawn from distillation column 80 through conduit 82. If desired, this high boiling material can be withdrawn for subsequent use or disposal. In preferred embodiments of the invention, this high boiling material is conveyed to a hydrotreating unit 90 through conduit 82 for removal of at least a portion of its sulfur content.

A gaseous mixture containing dihydrogen (molecular hydrogen) is supplied to a catalytic reactor of the hydrotreating unit 90 from storage or a refinery source 92 through conduit 94. Typically, the catalytic hydrotreating reactor contains one or more fixed bed of the same or different catalyst which have a hydrogenation-promoting action for desulfurization of the high boiling material. The reactor may be operated in up-flow, down-flow, or counter-current flow of the liquid and gases through the bed.

The extent of hydrogenation is dependent upon several factors which include selection of catalyst and conditions of reaction, and also the precise nature of the sulfur-containing organic impurities in the high boiling material. The conditions of reaction are desirably selected such that at least about 50 percent of the sulfur content of the sulfur-containing organic impurities is converted to hydrogen sulfide, and preferably so that the conversion to hydrogen sulfide is at least about 75 percent.

Typically a fixed bed of suitable catalyst is used in the catalytic reactor under conditions such that relatively long periods elapse before regeneration becomes necessary, for example an average reaction zone temperature of from about 50° C. to about 450° C., preferably from about 75° C. to about 255° C., and most preferably from about 200° C. to about 200° C. for best results, and at a pressure within the range of from about 6 to about 160 atmospheres. One or more beds of catalyst and subsequent separation and distillation operate together as an integrated hydrotreating and fractionation system. This system separates unreacted dihydrogen, hydrogen sulfide and other non-condensable products of hydrogenation from the effluent stream.

After removal of hydrogen sulfide, product is transferred from hydrotreating unit 90 to storage or a refinery blending unit (not shown) through conduit 96. Typically, the sulfur content of this product is less than about 50 parts per million, preferably less than about 30 parts per million and more preferably less than about 15 parts per million. If desired the resulting liquid mixture of condensable compounds is fractionated into a low-boiling fraction containing a minor amount of remaining sulfur and a high-boiling fraction containing a major amount of remaining sulfur.

EXAMPLES OF THE INVENTION

The following Examples will serve to illustrate certain specific embodiments of the herein disclosed invention. These Examples should not, however, be construed as limiting the scope of the novel invention as there are many variations which may be made thereon without departing from the spirit of the disclosed invention, as those of skill in the art will recognize.

General

The pilot-scale unit included two identical fixed-bed reactors which were operated in a serial down-flow mode with inter-reactor cooling of the process stream. Each reactor was charged with 300 mL of catalyst. The process stream flowed into the first reactor of the two reactor unit through a feed weigh tube, precision metering pump (Zenith), high pressure feed pump (Whitey), and an external preheater. Each reactor was disposed within a furnace equipped with six heating zones. Temperatures were measured along the centerline of each catalyst bed by thermocouples in various positions, and the heating zones were adjusted accordingly. An inter-reactor sampling system was located between the two reactors allowing the liquid process stream to be sampled at operating conditions.

During operation, the process stream was charged into the first reactor of the two reactor unit through a feed weigh tube, precision metering pump (Zenith), high pressure feed pump (Whitey), and an external preheater. The total effluent from the first reactor was transferred into the second reactor. The liquid product from the second reactor flowed into a high pressure separator where nitrogen was used to maintain the outlet pressure of the second reactor at the desired operating pressure. Level of the liquid in the separator was maintained by an Annin control valve.

In these examples of the invention, the naphtha feedstock, boiling over the range from about 61° C. to about 226° C., was obtained by fractional distillation of the products from the fluidized catalytic cracking of a gas oil feedstock which contained sulfur-containing impurities. Analysis of the naphtha feedstock using a multi-column gas chromatographic technique showed it to contain on a weight basis: 42.5 percent olefins (7.75 percent cyclic olefins), 15.6 percent aromatics, and 32.3 percent paraffins (9.41 percent cyclic paraffins). This naphtha feedstock was admixed with isopropyl alcohol to provide feedstock having an alkanol level of 240 parts per million.

Except were stated otherwise, the catalyst used for the examples was a solid phosphoric acid catalyst (C84-5-01 supplied by Sud Chemie, Inc., Louisville, Ky., USA) which was crushed to a Tyler screen mesh size of −12 +20 (USA Standard Testing Sieve by W. S. Tyler).

Unless otherwise indicated, percentages and parts per million (ppm) are on the bases of an appropriate weight.

EXAMPLE 1

In this example of the invention the two reactors were charged with the solid phosphoric acid catalyst having particle sizes Tyler screen mesh −12 +20, and operated at a liquid hourly space velocity of 1.5 $hr^{-1}$. Reactor one was maintained at a temperature of about 172° C., and reactor two at a temperature of about 122° C., i.e., a temperature differential between the serial reactors of negative 50° C. Analysis of the process stream is shown in Table I. The reduction in the total of 2-methyl and 3-methyl thiophenes was from about 254 ppm to about 3 ppm, a reduction of about 98.8 percent. The total of C2-thiophenes was reduced from about 125 ppm to about 29 ppm, a reduction of 76.8 percent. The reduction in the total of all sulfur compounds boiling at temperatures below 110° C. was from about 184 ppm to about 5.7 ppm, a reduction of 96.9 percent.

COMPARATIVE EXAMPLE

In this example, as in Example 1, the two reactors were charged with the solid phosphoric acid catalyst having particle sizes Tyler screen mesh −12 +20, and operated at a liquid hourly space velocity of 1.5 $hr^{-1}$. However, reactor one was maintained at a temperature of about 121° C., and reactor two at a temperature of about 172° C., i.e., a temperature differential between the serial reactors of positive 51° C. Analysis of the process stream is shown in Table II. The reduction in the total of 2-methyl and 3-methyl thiophenes was from about 254 ppm to about 5.42 ppm, a reduction of about 97.8 percent. The total of C2-thiophenes was reduced from about 125 ppm to about 43.16 ppm, a reduction of about 65.5 percent. The reduction in the total of all sulfur compounds boiling at temperatures below 110° C. was from about 184 ppm to about 20.52 ppm, a reduction of only about 88.8 percent.

In the comparative example the level of all sulfur compounds boiling at temperatures below 110° C. was, importantly, 3.58 times greater than in Example 1 of the invention.

EXAMPLE 2

Another pilot-scale unit which included one fixed-bed reactor was used to demonstrate the adsorption aspect of the invention, in particular, the capability of a solid phosphoric acid catalyst (C84-5-01 supplied by Sud Chemie, Inc.) to adsorb basic nitrogen compounds from a naphtha feedstock. This tubular, stainless steel, reactor had an internal diameter of 1.58 cm, and a total internal heated volume of about 80 $cm^3$. The centerline of the tubular reactor was disposed vertically. The reactor was charged with 20 mL of catalyst which was disposed between two beds of inert alumina packing.

The feed was prepared from a mixture of 90 percent naphtha from a catalytic cracking process and 10 percent naphtha from a thermal cracking process. The mixture, which contained 86 parts per million of basic nitrogen, was washed with an aqueous solution of sulfuric acid (10 percent) to less than 5 parts per million of basic nitrogen and 8 parts per million of total nitrogen. The washed mixture was admixed with triethylamine to provide a feed having a 15 parts per million level of basic nitrogen and total nitrogen of 23 parts per million. The feed was also admixed with isopropyl alcohol to provide feedstock having an alkanol level of 240 parts per million. The reactor was operated in a down-flow mode at a liquid hourly space velocity of 1.5 $hr^{-1}$, temperature of about 177° C., and a pressure of about of 34 atm. Analysis of effluent from the reactor showed a total nitrogen content of 8 parts per million, and no detectable amount of basic nitrogen. The solid phosphoric acid catalyst adsorbed all of the basic nitrogen impurities in the feed.

For the purposes of the present invention, "predominantly" is defined as more than about fifty percent. "Substantially" is defined as occurring with sufficient frequency or being present in such proportions as to measurably affect macroscopic properties of an associated compound or system. Where the frequency or proportion for such impact is not clear, substantially is to be regarded as about twenty percent or more. The term "a feedstock consisting essentially of" is defined as at least 95 percent of the feedstock by volume. The term "essentially free of" is defined as absolutely except that small variations which have no more than a negligible effect on macroscopic qualities and final outcome are permitted, typically up to about one percent.

TABLE I

ANALYSIS OF THE PROCESS STREAM FOR SERIAL REACTORS UNDER A TEMPERATURE DIFFERENTIAL OF NEGATIVE 50° C.

| Sulfur Compound | Reactor One Feed, ppm | Reactor Two Feed, ppm | Product, ppm |
|---|---|---|---|
| feed | 53.0 | 16 | 15 |
| methyl mercaptan | 0.97 | 0 | 0 |
| ethyl mercaptan | 29.4 | 0.30 | 0.28 |
| n-propyl mercaptan | 0 | 0.37 | 0.20 |
| isopropyl mercaptan | 7.39 | 1.24 | 0.89 |
| n-butyl mercaptan | 0 | 1.67 | 1.52 |
| 2-methyl,1-propanethiol | 1.48 | 0.12 | 0 |
| 2-methyl,2-propanethiol | 1.23 | 0.18 | 0.12 |
| amyl mercaptan | 0 | 0.41 | 0.13 |
| methyl sulfide | 0.85 | 0.43 | 0.41 |
| carbon disulfide | 0.23 | 0.38 | 0.18 |
| ethyl methyl sulfide | 2.3 | 1.08 | 0.9 |
| tetrahydrathiophene | 28.3 | 12.9 | 9.12 |
| thiophene | 117.6 | 1.7 | 1 |
| C1-T | 253.58 | 5.8 | 3.1 |
| C2-T | 124.97 | 38.17 | 28.83 |

TABLE I-continued

ANALYSIS OF THE PROCESS STREAM FOR SERIAL REACTORS UNDER A TEMPERATURE DIFFERENTIAL OF NEGATIVE 50° C.

| Sulfur Compound | Reactor One Feed, ppm | Reactor Two Feed, ppm | Product, ppm |
|---|---|---|---|
| S < 110° C. | 184.06 | 7.58 | 5.73 |

C1-T is a total of 2-methyl thiophenes and 3-methyl thiophenes.
C2-T is a total of C2 thiophenes.
S < 110° C. is a total of all sulfur compounds boiling at temperatures below 110° C.

TABLE II

ANALYSIS OF THE PROCESS STREAM FOR SERIAL REACTORS UNDER A TEMPERATURE DIFFERENTIAL OF POSITIVE 51° C.

| Sulfur Compound | Reactor One Feed, ppm | Reactor Two Feed, ppm | Product, ppm |
|---|---|---|---|
| feed | 53.0 | 9 | 24 |
| methyl mercaptan | 0.97 | 0 | 0 |
| ethyl mercaptan | 29.4 | 0.21 | 1.25 |
| n-propyl mercaptan | 0 | 0.26 | 1.19 |
| isopropyl mercaptan | 7.39 | 0.46 | 2.20 |
| n-butyl mercaptan | 0 | 2.03 | 4.11 |
| 2-methyl,1-propanethiol | 1.48 | 0.11 | 0.20 |
| 2-methyl,2-propanethiol | 1.23 | 0.18 | 0.41 |
| amyl mercaptan | 0 | 0.14 | 0.27 |
| methyl sulfide | 0.85 | 0.51 | 0.62 |
| carbon disulfide | 0.23 | 0.24 | 0.33 |
| ethyl methyl sulfide | 2.3 | 1.22 | 1.48 |
| tetrahydrathiophene | 28.3 | 21.2 | 10.39 |
| thiophene | 117.6 | 12.8 | 2.38 |
| C1-T | 253.58 | 28.23 | 5.42 |
| C2-T | 124.97 | 60.31 | 43.16 |
| S < 110° C. | 184.06 | 16.21 | 20.52 |

C1-T is a total of 2-methyl thiophenes and 3-methyl thiophenes.
C2-T is a total of C2 thiophenes.
S < 110° C. is a total of all sulfur compounds boiling at temperatures below 110° C.

That which is claimed is:

1. A process for the production of products which are liquid at ambient conditions and contain organic sulfur compounds of higher molecular weight than corresponding sulfur-containing compounds in the feedstock, which process comprises:

providing a feedstock comprising a mixture of hydrocarbons which includes olefins, and sulfur-containing organic compounds and nitrogen-containing organic compounds, the feedstock consisting essentially of material boiling between about 60° C. and about 345° C. and having a sulfur content up to about 4,000 or 5,000 parts per million and a nitrogen content up to about 2,000 parts per million;

passing the feedstock through a bed of solid adsorbent, under conditions suitable for adsorption within the bed, to effect selective adsorption and/or complexing of at least a portion of the contained nitrogen-containing organic compounds with the adsorbent, and thereby obtain effluent from the bed which contains less nitrogen-containing organic compounds than the feedstock;

in a first contacting stage at elevated temperatures, contacting the effluent with an acidic catalyst under conditions which are effective to convert a portion of the sulfur-containing organic compounds to a sulfur-containing material of higher molecular weight through alkylation by the olefins, thereby forming an initial product stream; and in a subsequent contacting stage and at temperatures at least 10 C lower than the average of the elevated temperatures in the first contacting stage, contacting at least a portion of the initial product stream with an acidic catalyst under conditions which are effective to convert a portion of the sulfur-containing organic compounds to a sulfur-containing material of higher molecular weight through alkylation by the olefins, thereby forming a subsequent product stream.

2. The process of claim 1 wherein the feedstock is comprised of a naphtha from a catalytic cracking process and/or a thermal cracking process.

3. The process of claim 1 wherein the solid adsorbent is comprised of a material which is prepared from an acidic catalyst by use in at least one of the contacting stages.

4. The process of claim 1 wherein the olefin content of the feedstock is at least equal on a molar basis to that of the sulfur-containing organic compounds.

5. The process of claim 1 wherein a solid phosphoric acid catalyst is used as the acidic catalyst in at least one of the contacting stages.

6. The process of claim 1 wherein the elevated temperatures used in the initial contacting stage are in a range from about 100° C. to about 235° C.

7. The process of claim 1 wherein the acidic catalyst of the subsequent contacting stage is comprised of a material which is prepared from an acidic catalyst by use in the first contacting stage, and the solid adsorbent is comprised of a material which is prepared from the acidic catalyst by use in the first contacting stage and/or the subsequent contacting stage.

8. The process of claim 1 wherein the acidic catalyst is comprised of a solid phosphoric acid catalyst, and wherein the feedstock is comprised of a hydrating agent in an amount which exhibits a capability to enhance performance of the catalyst.

9. The process of claim 8 wherein the hydrating agent is at least one member of the group consisting of alkanols having from about 2 to about 5 carbon atoms.

10. The process of claim 8 wherein the temperatures in the subsequent contacting stage are at least 15° C. lower than an average of the elevated temperatures in the initial contacting stage.

11. A process for the production of products which are liquid at ambient conditions and have a reduced content relative to the feedstock, which process comprises:

providing a feedstock comprising a mixture of hydrocarbons which includes olefins, nitrogen containing organic compounds and sulfur-containing organic compounds and nitrogen-containing organic compounds, the feedstock consisting essentially of material boiling between about 60° C. and about 345° C. and having a sulfur content up to about 4,000 or 5,000 parts per million;

passing the feedstock through a bed of solid adsorbent, under conditions suitable for adsorption within the bed, to effect selective adsorption and/or complexing of at least a portion of the contained nitrogen-containing organic compounds with the adsorbent, and thereby obtain effluent from the bed which contains less nitrogen-containing organic compounds than the feedstock;

in a first contacting stage at elevated temperatures, contacting the effluent with an acidic catalyst under conditions which are effective to convert a portion of the sulfur-containing organic compounds to a sulfur-containing material of higher molecular weight through alkylation by the olefins, thereby forming an initial product stream;

in a subsequent contacting stage and at temperatures at least 10 C lower than the average of the elevated temperatures in the first contacting stage, contacting at least a portion of the initial product stream with an acidic catalyst under conditions which are effective to convert a portion of the sulfur-containing organic compounds to a sulfur-containing material of higher molecular weight through alkylation by the olefins, thereby forming a subsequent product stream; and fractionating the subsequent product stream by distillation to provide at least one low boiling fraction consisting of a sulfur-lean, fraction having a sulfur content less than about 50 ppm, and a higher-boiling fraction consisting of a sulfur-rich, fraction containing the balance of the sulfur.

12. The process of claim 11 wherein the solid adsorbent is comprised of a material which is prepared from an acidic catalyst by use in at least one of the contacting stages.

13. The process of claim 11 wherein the olefin content of the feedstock is at least equal on a molar basis to that of the sulfur-containing organic compounds, and wherein the acidic catalyst of the subsequent contacting stage is comprised of a material which is prepared from an acidic catalyst by use in the first contacting stage, and the solid adsorbent is comprised of a material which is prepared from the acidic catalyst by use in the first contacting stage and/or the subsequent contacting stage.

14. The process of claim 11 wherein the elevated temperatures used in the initial contacting stage are in a range from about 100° C. to about 235° C.

15. The process of claim 11 wherein the acidic catalyst in at least one of the contacting stages is a solid phosphoric acid catalyst, and wherein the feedstock is comprised of a hydrating agent in an amount which exhibits a capability to enhance performance of the catalyst.

16. The process of claim 11 wherein the elevated temperatures used in the initial contacting stage are in a range from about 110° C. to about 220° C., and wherein the temperatures used in the subsequent contacting stage is at least 30° C. lower than an average of the elevated temperatures in the initial contacting stage.

17. The process of claim 11 wherein the one low-boiling fraction has a distillation end point and the high-boiling fraction has an initial boiling point such that the distillation end point and the initial boiling point are in the range from about 80° C. to about 220° C.

18. The process of claim 11 wherein the high-boiling fraction has a distillation end point which is below about 249° C.

19. A process for the production of products which are liquid at ambient conditions and have a reduced content relative to the feedstock, which process comprises:

providing a feedstock comprising a mixture of hydrocarbons which includes olefins, nitrogen containing organic compounds and sulfur-containing organic compounds and nitrogen-containing organic compounds, the feedstock consisting essentially of material boiling between about 60° C. and about 345° C. and having a sulfur content up to about 4,000 or 5,000 parts per million;

passing the feedstock through a bed of solid adsorbent, under conditions suitable for adsorption within the bed, to effect selective adsorption and/or complexing of at least a portion of the contained nitrogen-containing organic compounds with the adsorbent, and thereby obtain effluent from the bed which contains less nitrogen-containing organic compounds than the feedstock;

in a first contacting stage at elevated temperatures, contacting the effluent with an acidic catalyst under conditions which are effective to convert a portion of the sulfur-containing organic compounds to a sulfur-containing material of higher molecular weight through alkylation by the olefins, thereby forming an initial product stream;

in a subsequent contacting stage and at temperatures at least 10 C lower than the average of the elevated temperatures in the first contacting stage, contacting at least a portion of the initial product stream with an acidic catalyst under conditions which are effective to convert a portion of the sulfur-containing organic compounds to a sulfur-containing material of higher molecular weight through alkylation by the olefins, thereby forming a subsequent product stream;

fractionating the subsequent product stream by distillation to provide at least one low boiling fraction consisting of a sulfur-lean, fraction having a sulfur content less than about 50 ppm, and a higher-boiling fraction consisting of a sulfur-rich, mono-aromatic-lean fraction containing the balance of the sulfur;

treating the high-boiling fraction with a gaseous source of dihydrogen at hydrogenation conditions in the presence of a hydrogenation catalyst which exhibits a capability to enhance the incorporation of hydrogen into one or more of the sulfur-containing organic compounds and under conditions suitable for hydrogenation of one or more of the sulfur-containing organic compounds; and recovering a high-boiling liquid having a sulfur content less than about 50 ppm.

20. The process according to claim 19 wherein the hydrogenation catalyst comprises at least one active metal, selected from the group consisting of the d-transition elements, each incorporated onto an inert support in an amount of from about 0.1 percent to about 20 percent by weight of the total catalyst.

21. The process according to claim 19 wherein the hydrogenation catalyst comprises one or more metals selected from the group consisting of cobalt, nickel, molybdenum and tungsten.

22. The process according to claim 19 wherein the olefin content of the feedstock is at least equal on a molar basis to that of the sulfur-containing organic compounds, and wherein the solid adsorbent is comprised of a material which is prepared from an acidic catalyst by use in at least one of the contacting stages.

23. The process according to claim 19 wherein the acidic catalyst of the subsequent contacting stage is comprised of a material which is prepared from an acidic catalyst by use in the first contacting stage, and the solid adsorbent is comprised of a material which is prepared from the acidic catalyst by use in the first contacting stage and the subsequent contacting stage.

24. The process according to claim 19 wherein the treating of the high-boiling fraction with a gaseous source of dihydrogen employs at least one bed of hydrogenation catalyst comprising nickel and one or more metals selected from the group consisting of, molybdenum and tungsten, each incorporated onto an inert support in an amount of from about 0.1 percent to about 20 percent by weight of the total catalyst.

* * * * *